US007451600B2

(12) United States Patent
Patel et al.

(10) Patent No.: US 7,451,600 B2
(45) Date of Patent: Nov. 18, 2008

(54) GAS TURBINE ENGINE COMBUSTOR WITH IMPROVED COOLING

(75) Inventors: Bhawan Patel, Mississauga (CA); Parthasarathy Sampath, Mississauga (CA); Russell Parker, Oakville (CA)

(73) Assignee: Pratt & Whitney Canada Corp., Longueuil (CA)

( * ) Notice: Subject to any disclaimer, the term of this patent is extended or adjusted under 35 U.S.C. 154(b) by 502 days.

(21) Appl. No.: 11/175,046

(22) Filed: Jul. 6, 2005

(65) Prior Publication Data

US 2007/0006588 A1 Jan. 11, 2007

(51) Int. Cl.
*F23R 3/10* (2006.01)
*F23R 3/54* (2006.01)

(52) U.S. Cl. ..... 60/752; 60/754; 60/760

(58) Field of Classification Search ..... 60/752, 60/754, 755, 756, 758, 760
See application file for complete search history.

(56) References Cited

U.S. PATENT DOCUMENTS

| | | | | |
|---|---|---|---|---|
| 2,669,090 | A | 2/1954 | Jackson | |
| 3,169,387 | A | 2/1965 | Hussey | |
| 4,339,925 | A | 7/1982 | Eggmann et al. | |
| 4,949,545 | A | 8/1990 | Shekleton | |
| 5,012,645 | A | 5/1991 | Reynolds | |
| 5,094,069 | A * | 3/1992 | Boffo | 60/760 |
| 5,129,231 | A | 7/1992 | Becker et al. | |
| 5,142,871 | A | 9/1992 | Lampes et al. | |
| 5,297,385 | A | 3/1994 | Dubell et al. | |
| 5,307,637 | A * | 5/1994 | Stickles et al. | 60/756 |
| 5,396,759 | A * | 3/1995 | Richardson | 60/756 |
| 5,590,531 | A | 1/1997 | Desaulty et al. | |
| 6,079,199 | A | 6/2000 | McCaldon et al. | |
| 6,105,371 | A | 8/2000 | Ansart et al. | |
| 6,427,446 | B1 | 8/2002 | Kraft et al. | |
| 6,606,861 | B2 | 8/2003 | Snyder | |
| 6,751,961 | B2 * | 6/2004 | Pacheco-Tougas et al. | 60/756 |
| 6,810,673 | B2 | 11/2004 | Snyder | |
| 7,260,936 | B2 * | 8/2007 | Patel et al. | 60/754 |
| 2003/0182943 | A1 * | 10/2003 | Gerendas et al. | 60/754 |
| 2006/0272335 | A1 * | 12/2006 | Schumacher et al. | 60/752 |

* cited by examiner

*Primary Examiner*—Ted Kim
(74) *Attorney, Agent, or Firm*—Ogilvy Renault LLP

(57) ABSTRACT

A gas turbine engine combustor liner having a plurality of holes defined therein for directing air into the combustion chamber. The plurality of holes provide improved cooling efficiency in regions of the combustor dome corresponding to predetermined hotspots.

16 Claims, 4 Drawing Sheets

GAS TURBINE ENGINE COMBUSTOR WITH IMPROVED COOLING

TECHNICAL FIELD

The invention relates generally to a combustor of a gas turbine engine and, more particularly, to a combustor having improved cooling.

BACKGROUND OF THE ART

Cooling of combustor walls is typically achieved by directing cooling air through holes in the combustor wall to provide effusion and/or film cooling. These holes may be provided as effusion cooling holes formed directly through a sheet metal liner of the combustor walls. Opportunities for improvement are continuously sought, however, to provide improved cooling, better mixing of the cooling air, better fuel efficiency and improved performance, all while reducing costs.

Further, a new generation of very small turbofan gas turbine engines is emerging (i.e. a fan diameter of 20 inches or less, with about 2500 lbs. thrust or less), however known cooling designs have proved inadequate for cooling such relatively small combustors, as larger combustor designs cannot simply be scaled-down, since many physical parameters do not scale linearly, or at all, with size (droplet size, drag coefficients, manufacturing tolerances, etc.).

Accordingly, there is a continuing need for improvements in gas turbine engine combustor design.

SUMMARY OF THE INVENTION

It is therefore an object of this invention to provide a gas turbine engine combustor having improved cooling.

In one aspect, the present invention provides a gas turbine engine combustor comprising a liner enclosing a combustion chamber, the liner including a dome portion at an upstream end thereof and at least one annular liner wall extending downstream from and circumscribing said dome portion, the dome portion having defined therein a plurality of openings each adapted to receive a fuel nozzle, said dome portion having a plurality of cooling holes defined through a wall panel thereof for directing cooling air into the combustion chamber, said plurality of cooling holes including a first set of cooling holes disposed within predetermined regions of said dome portion corresponding to identified hotspots therein and a second set of cooling holes disposed outside said regions, said regions being located between each of said fuel nozzle openings, wherein said regions having said first set of cooling holes provide an improved cooling efficiency than similarly sized areas of said dome portion having said second set of cooling holes therein.

In another aspect, the present invention provides a gas turbine engine combustor comprising at least an annular liner wall portion and a dome portion enclosing a combustion chamber, the dome portion having defined therein a plurality of openings each adapted to receive a fuel nozzle for directing fuel into the combustion chamber, the dome portion having means for directing cooling air into the combustion chamber, said means providing more cooling efficiency in regions of said dome portion corresponding to predetermined hotspots located circumferentially between each of said openings.

In another aspect, the present invention provides a combustor for a gas turbine engine comprising: combustor walls including inner and outer cylindrical liners spaced apart and circumscribing an upstream annular dome portion, the combustor walls defining at least a portion of a combustion chamber therewithin; a plurality of fuel nozzles for injecting a fuel mixture into the combustion chamber, said fuel nozzles aligned with corresponding fuel nozzle openings defined in said dome portion; and a plurality of cooling apertures defined through said dome portion for delivering pressurized cooling air surrounding said combustor into said combustion chamber, said cooling apertures including first cooling holes and second cooling holes, said second cooling holes defining concentric circular configurations around each of said fuel nozzle openings and are angled in the dome portion substantially tangentially relative to an associated one of said fuel nozzle openings, said first cooling holes being disposed in regions defined between adjacent concentric circular configurations of said second cooling holes and located proximate to the outer cylindrical liner, said first cooling holes extending substantially perpendicularly through the dome portion.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
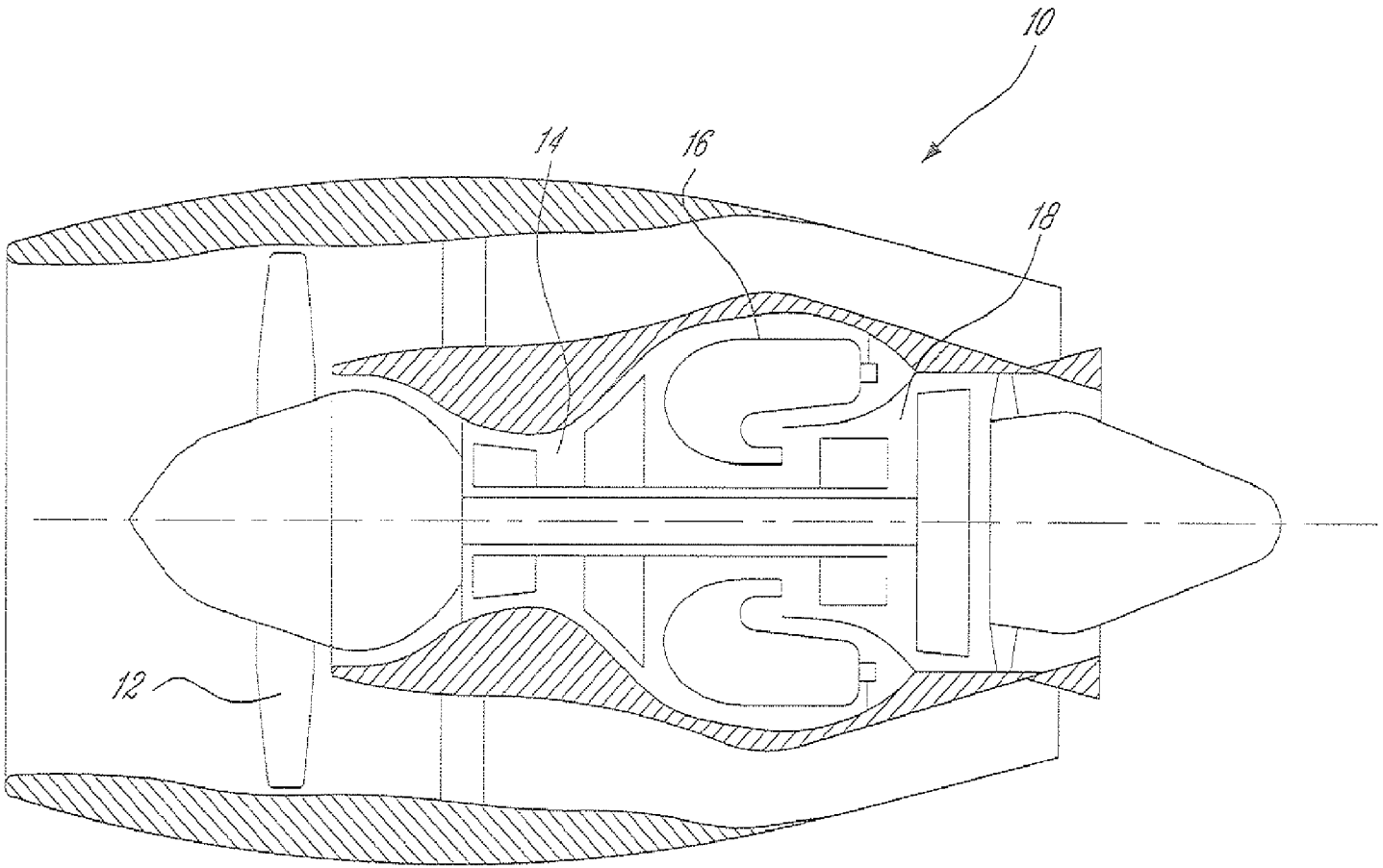
FIG. 1 is a schematic partial cross-section of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
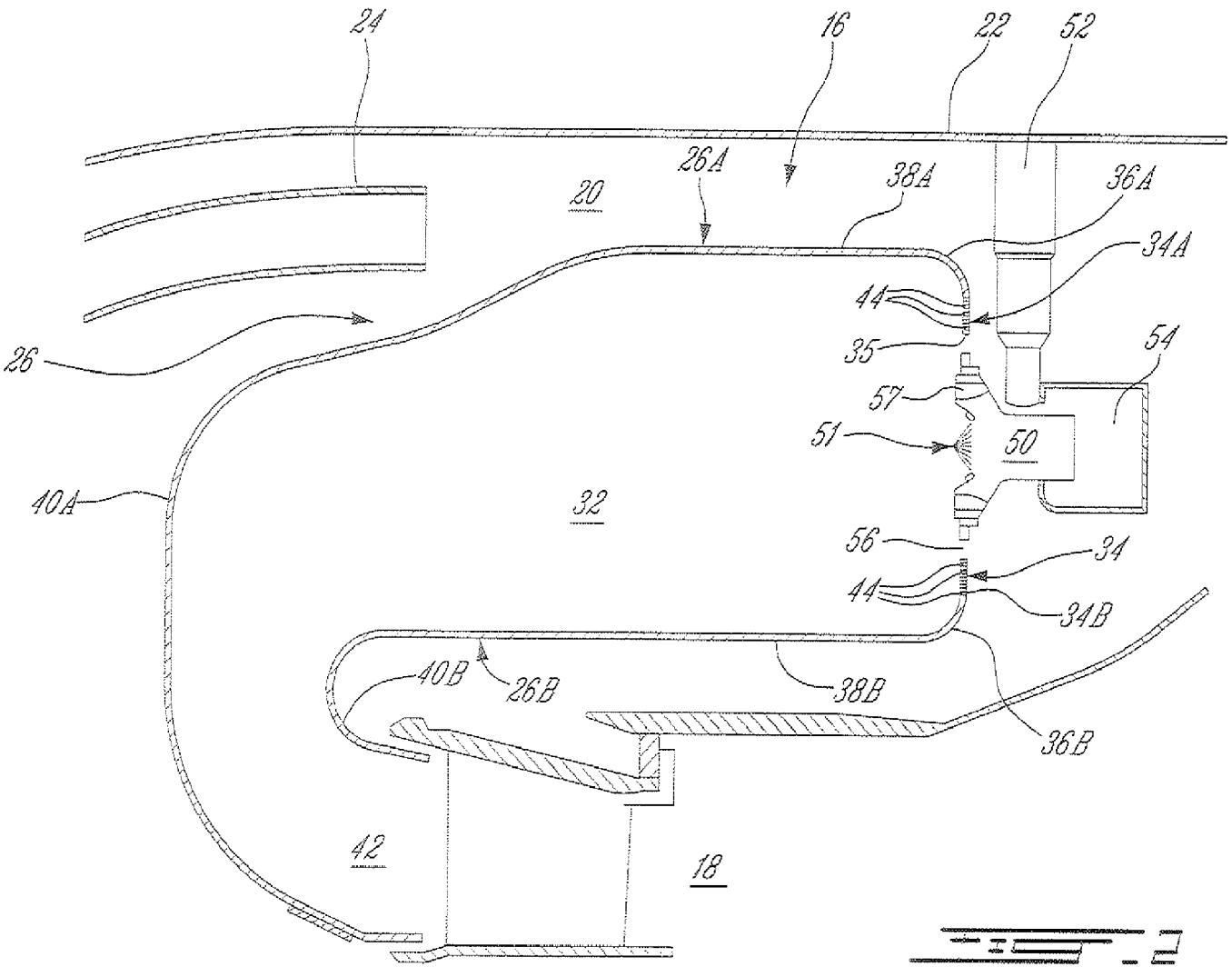
FIG. 2 is partial cross-section of a reverse flow annular combustor having cooling holes in a dome portion of the upstream end thereof in accordance with one aspect of the present invention.

Referring to FIG. 2, the combustor 16 is housed in a plenum 20 defined partially by a gas generator case 22 and supplied with compressed air from compressor 14 via a diffuser 24. The combustor 16 is an annular reverse-flow combustor in this embodiment. Combustor 16 comprises generally a liner 26 which includes an outer liner 26A and an inner liner 26B which are radially spaced apart and joined at an upstream end by an annular dome portion 34. The combustor liner 26 defines a combustion chamber volume 32 therewithin. Outer liner 26A includes an outer dome panel portion 34A, a relatively small radius transition portion 36A, a cylindrical wall portion 38A, and a long exit duct portion 40A, while inner liner 26B includes an inner dome panel portion 34B, a relatively small radius transition portion 36B, a cylindrical wall portion 38B, and a small exit duct portion 40B. The exit ducts 40A and 40B together define a combustor exit plane 42 for communicating with turbine section 18. The combustor liner 26 is preferably composed of a suitable sheet metal. A plurality of cooling holes 44 are preferably provided in the dome portion 34 of the combustor 16. Although additional cooling holes may also be provided elsewhere in the combustor liner, such as in the cylindrical walls 38A, 38B for example, the cooling holes 44 disposed in the dome region of the combustor will be described in detail below.

A plurality of fuel nozzles 50 are located by supports 52 and supplied with fuel from an internal manifold 54. The fuel nozzles are disposed in communication with the combustion chamber 32 to deliver a fuel-air mixture to the chamber 32. Particularly, a plurality of fuel nozzle openings 35 are defined through the dome portion 34, preferably midway between the cylindrical walls of the inner and outer liners 26B and 26A. The openings 35 are preferably circumferentially spaced about the full extent of the annular dome portion 34. Injection tips 51 of the fuel nozzles 50 protrude into the combustion chamber 32 through said openings 35 in the dome portion 34 of the combustor. When the fuel nozzles 50 are so mounted in position, annular gaps 56 defined between the fuel nozzle tips 50 and the inner surfaces of the openings 35 in the dome portion may be left for injection therethrough of additional cooling and/or combustion air from the plenum 20 into the combustion chamber 32. Cooling air is also enters the combustion chamber 32 via the plurality of cooling holes 44 defined through the dome portion 34 of the combustor's upstream end through which the fuel nozzles project.

In use, compressed air enters plenum 20 from diffuser 24. The air circulates around combustor 16 and eventually enters combustion chamber 32 through a variety of apertures defined in the combustor liner 26, such as the cooling holes 44, following which some of the compressed air is mixed with fuel, injected by the fuel nozzles 50, for combustion. Combustion gases are exhausted through the combustor exit 42 to the turbine section 18. The air flow apertures defined in the liner include, but not exclusively, the cooling holes 44 in the upstream dome portion of the combustor. While the combustor 16 is depicted and will be described below with particular reference to the dome cooling holes 44, it is to be understood that compressed air from the plenum 20 also enters the combustion chamber via other apertures in the combustor liner 26, such as combustion air flow apertures defined in the cylindrical walls 38A,38B, the openings 56 surrounding the fuel nozzles 50, air flow passages 57 through the fuel nozzles 50 themselves, and a plurality of other cooling apertures (not shown) which may be provided throughout the liner 26 for effusion/film cooling of the liner walls. Therefore while only the dome portion cooling holes 44 are depicted, a variety of other apertures may be provided in the liner for cooling purposes and/or for injecting combustion air into the combustion chamber. While compressed air which enters the combustor, particularly through and around the fuel nozzles 50, is mixed with fuel and ignited for combustion, some air which is fed into the combustor is preferably not ignited and instead provides air flow to effusion cool the wall portions of the liner 26. Other considerations such as ability to light, flame out margin, etc. may influence the magnitude of cooling air required.

Figure 3:
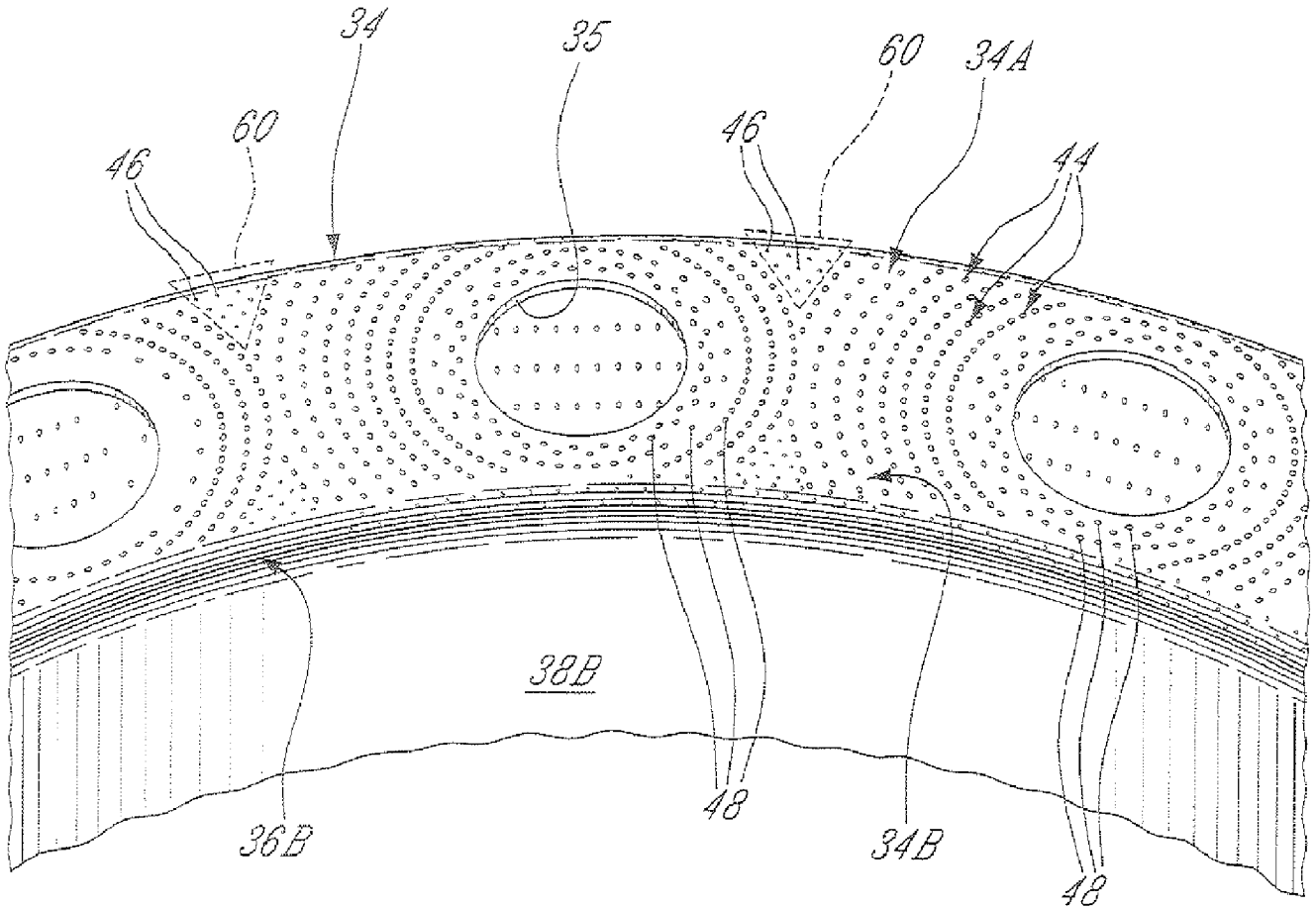
FIG. 3 is a partial perspective view of the dome portion of the combustor of FIG. 2.

Referring now to FIG. 3, as mentioned the combustor liner 26 includes a plurality of cooling air holes 44 formed in the dome portion 34 of the combustor, such that effusion cooling is achieved at this upstream end of the combustor 16 by directing compressed air though the cooling holes 44. As this end of the combustor is closest to the fuel nozzles 50, and therefore to the air-fuel mixture which is ejected therefrom and ignited, sufficient cooling in this region of the combustor is particularly vital.

The plurality of cooling holes 44 defined in the dome portion 34 are preferably comprised of at least two main groups, namely first cooling holes 46 and second cooling holes 48.

The second cooling holes 48 are provided in a concentric circular configuration around each nozzle opening 35, and are angled in the panel wall of the dome portion generally tangentially relative to an associated opening 35, such that air delivered into the combustion chamber through the second cooling holes 48 creates a circular or helical cooling airflow pattern around each opening 35. In use, air entering combustor 16 through second holes 48 will tend to spiral around nozzle openings 35 in a helical fashion, and thus create a vortex around fuel sprayed by the fuel nozzles 50. This spiral effusion cooling hole pattern of the second cooling holes 48 develops a spiral film cooling on the dome portion and the rest of the combustor liner. This is described in further detail in U.S. patent application Ser. No. 10/927,516 filed Aug. 27, 2004, the entire contents of which are incorporated herein by reference.

Such a spiral effusion cooling scheme however, if provided without any additional cooling holes, may tend to cause certain regions of the dome portion 34 to become hotter (i.e. are less effectively cooled) than the rest of the dome portion. This is at least partly caused by the interlacing of adjacent spiral groups of cooling holes 48. In these interlaced regions, particularly in the regions 60 (absent any other additional holes therein) defined adjacent the outer radial edge of the dome portion, the direction of angled cooling holes 48 through the dome wall following the rest of the spiral hole pattern would be oriented against the direction of cooling flow flowing about the radially outer edge of the dome end of the combustor. Thus, within these regions 60, less cooling air would thus be able to flow through the cooling holes should only angled cooling holes 48 be provided therein. As such, first cooling holes 46 are provided in these regions 60, as will be discussed further below. Any reduced cooling effect in these regions is further impacted by the limited air flow in the wake regions 80, namely low-pressure regions where flow separation has occurred as it flows around the dome end of the combustor, located proximate the outer edges of the combustor dome panel portion 34A as is described in greater detail below with reference to FIGS. 4 and 5.

First cooling holes 46 are therefore arranged in the regions 60 of the outer dome panel portion 34A of the combustor dome portion 34 in order to improve the cooling efficiency in these regions which would otherwise be exposed to locally higher temperatures. As such, increased cooling air flow through the dome portion 34 within regions 60 is provided. The first cooling holes 46 improve cooling efficiency within the regions 60 at least partly by being directed perpendicularly through the liner wall of the dome portion 34. In other words, the first cooling holes 46 extend "straight-through" the dome wall, such that each of the cooling holes 46 is angled at 90 degrees relative to the surface of the dome wall 34A, 34B. This enables the cooling air outside the combustor to be able to more easily flow through the dome wall within the regions 60.

The regions 60 of first cooling holes 46 are thus disposed between each of the fuel nozzle openings 35 in the radially outer dome panel portion 34A of the combustor dome 34, and are therefore adjacent a radial outer edge of the dome portion 34 near the outer cylindrical liner wall 38A. As a result of the preferred concentric circular array arrangement of second cooling holes 48 around openings 35, the regions 60 of first cooling holes 46 between adjacent circular arrays are resultantly approximately triangular in shape, with a side of the triangle being located radially outward, proximate the outer annular rim of the outer dome panel portion 34A—i.e. roughly tangent to the combustor annulus. The "upside down" triangle, or "inverse fir tree", shape of the regions 60 are therefore located between the adjacent spiral or circular arrangements of second cooling holes 48. While other arrangements of holes 48 around openings 35 will corresponding affect the shape of regions 60, the regions 60 will still nonetheless correspond to identified regions of local high temperature of the dome portion 34 of the combustor between arrays/arrangements of the holes 48 around adjacent openings 35.

As noted above, greater cooling effectiveness is provided within regions 60 of the dome portion 34 of the combustor 16, to cool such predetermined areas thereof. This is at least partly achieved by orienting the first cooling holes 46 perpendicularly (i.e. at 90 degrees to the wall surface) through the combustor's dome portion. The 90 degree angle of the holes 46 acts to improve the drag coefficient of the holes and thereby increases the momentum of the air at the exit of the holes inside the combustor liner within the regions 60. Accordingly, the drag coefficient of the first holes 46 within the regions 60 is preferably lower than that of the second holes 48 outside the regions 60.

Additionally, cooling effectiveness within the regions 60 may also be further improved by spacing the first cooling holes 46 closer together than the second cooling holes 48. In other words, the first cooling holes 46 are formed in the dome portion 34 at a preferably higher spacing density relative to the spacing density of the second cooling holes 48 disposed outside the regions 60. Thus, more first cooling holes 46 are preferably provided in a given area of liner wall within the regions 60 than second cooling holes 48 in a similarly sized area of the liner wall outside the regions 60. However, it is to be understood that other hole densities and diameters can also be used to provide the appropriate cooling air flow within the identified regions 60 of local high temperature relative to the rest of the combustor liner. For example, the spacing densities of both first and second cooling holes 46, 48 may be the same, but the diameters of the first cooling holes 46 may be larger than those of the second cooling holes 48, or both the spacing density and the diameters of the first and second cooling holes may be different. As well, the spacing density in regions 60 may be less than for cooling holes 48. The exact parameters are within the control and desire of the designer.

These aspects of the invention are particularly suited for use in very small turbofan engines which have begun to emerge. Particularly, the correspondingly small combustors of these very small gas turbine engines (i.e. a fan diameter of 20 inches or less, with about 2500 lbs. thrust or less) require improved cooling, as the cooling methods used for larger combustor designs cannot simply be scaled-down, since many physical parameters do not scale linearly, or at all, with size (droplet size, drag coefficients, manufacturing tolerances, etc.).

Figure 5:
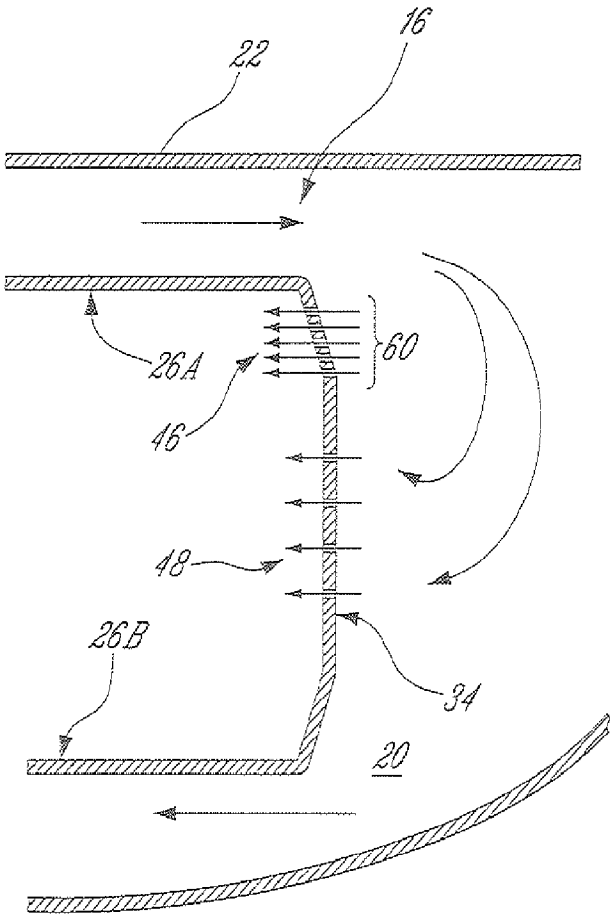
FIG. 5 is similar to FIG. 4, but showing one effect of one aspect of the present invention.
Figure 4:
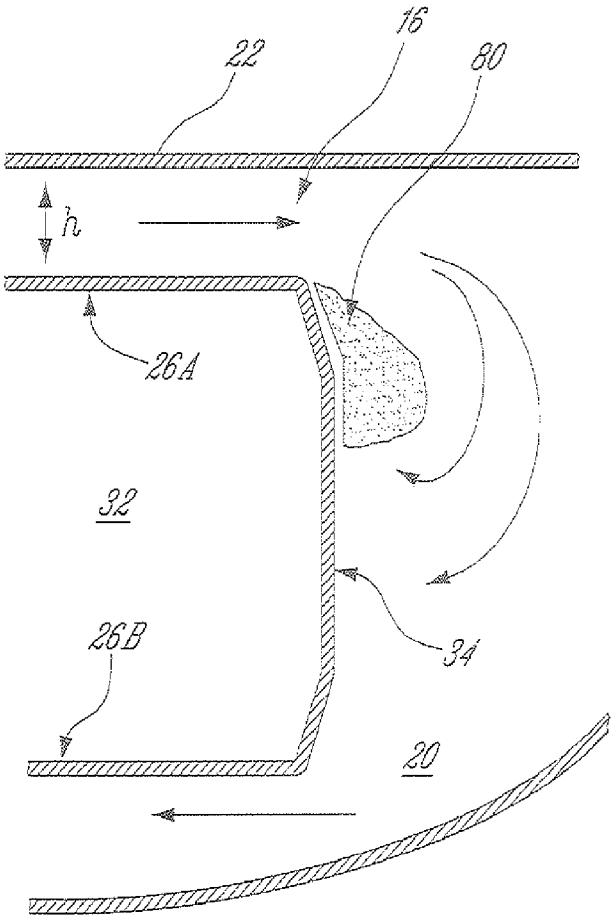
FIG. 4 is a partial schematic cross-sectional view of the upstream end of the combustor of FIG. 2, schematically depicting an aspect of the device in use.

Referring to FIGS. 4 and 5, in some combustor installations, particularly such as small reverse-flow combustors of the above-mentioned very small gas turbine engines, flow restrictions may exist upstream of dome 34, which may be caused, for example, by a small clearance h between case 22 and combustor 16 (in this case) and/or by the presence of airflow obstructions outside the combustor outside the combustor dome, such as (referring to FIG. 2) the supports 52, the fuel manifold 54 and/or igniters (not shown) or other obstructions. These flow restrictions typically result in higher flow velocity between case 22 and liner 26 than is present in engines without such geometries, and these velocities are especially high around the outer liner/dome intersection, and may result in a "wake area" being generated (designated schematically by the shaded region 80), in which the air pressure will be lower than the surrounding flow. Consequently, air entering combustor 16 through the effusion cooling holes 44 adjacent this wake area 80 will have relatively lower momentum, which negatively impacts cooling performance in these areas. This problem is particularly acute in the next generation of very small gas turbofan engines, having a fan diameter of 20 inches or less, 2500 lbs. thrust or less. Larger prior art gas turbines have the 'luxury' of a relatively larger cavity around the liner and thus may avoid such restrictions altogether. However, in very small turbofans, space is at an absolute a premium, and such flow restrictions are all but unavoidable. As such, for such very small gas turbine engines, the low annular combustor height (h) between the outer liner wall 26A of the combustor 16 and the surrounding casing 22 tends to cause the wake regions 80 as the compressed air flows around the corner between the outer liner wall 26A and the dome portion 34 of the reverse-flow combustor 16.

Exacerbating the problem created by the wake area, in a combustor configuration where the effusion cooling holes in the upper half of dome 34A are directed away from the combustor centre, air entering these holes must thus essentially reverse direction relative to the air flow outside the combustor adjacent the wake area. This further reduces the momentum of air entering in the combustion chamber in this area. Consequently, further reduced cooling effectiveness results adjacent this area. This results in the upper half of the dome and combustor outer liner being very hot compared to bottom half/inner liner. To address this problem, in one aspect of the cooling hole pattern of the present invention, the first cooling holes 46 (represented schematically by the thicker arrows 46) are perpendicularly directed through the liner wall in regions 60 of the outer half of the dome portion 34, in order to prove increased cooling effectiveness within these regions. Therefore, effusion cooling airflow in the regions 60 of the dome portion adjacent the wake area 80 is improved by reducing the overall drag coefficient ($C_d$) for cooling air flowing through the first cooling holes 46. This is achieved by orienting the first cooling holes 46 "straight-through" the dome wall (i.e. angled at 90 degrees or generally perpendicularly relative the surface of the dome portion 34 in the flat-domed embodiment described, which is thus generally parallel to the combustor or engine axis). Thus, the drag coefficient of the holes is reduced, thereby increasing the momentum of the air at the exit of the holes. This accordingly improves the overall cooling efficient within the regions 60.

The regions 60 of the combustor dome portion 34 for such a small combustor 16 are thus provided with more localized and directed cooling than other regions of the combustor liner, which are less prone higher temperatures and/or less efficient cooling. This is at least partly achieved using the groups of first cooling apertures 46 defined within the regions 60, which direct an optimized volume of coolant to these regions and in a direction which will not adversely effecting the combustion of the air-fuel mixture within the combustion chamber (i.e. by preventing the coolant air from being used as combustion air). As well as maximizing air flow momentum through the first cooling holes 46 of the regions 60, cooling effectiveness may additionally be improved by optimizing the density of the holes within these regions 60, while leaving the hole density in other portions of the combustor's dome outside these regions unaffected. By improving the cooling effectively within the regions 60, the durability of the dome portion of the combustor may therefore be improved, preferably without adversely affecting the flame-out, flame stability, combustion efficiency and/or the emission characteristics of the combustor.

The combustor liner 26 is preferably provided from an appropriate sheet metal, and the plurality of cooling holes 44 are preferably drilled in the sheet metal, such as by laser drilling. However, other suitable combustor materials and construction methods may also be used. The present invention is believed to be best implemented with a combustor having a flat dome panel. Although the invention may also be applied to conical, curved or other shaped dome panels, it is believed that the spiral flow which is introduced inside the liner will be inferior to that provided by the present hole pattern in a flat dome panel. Further, the invention may also be used in combination with internal heat shields mounted within the combustor liner to the inner surfaces of the dome portion 34, wherein such heat shields have spiral cooling holes therethrough for improving cooling and improving mixing within the combustion chamber.

The above description is meant to be exemplary only, and one skilled in the art will recognize that changes may be made to the embodiments described without department from the scope of the invention disclosed. For example, although the use of holes for directing air is preferred, other means such as slits, louvers, etc. may be used in place of or in addition to holes. Still other modifications which fall within the scope of the present invention will be apparent to those skilled in the art, in light of a review of this disclosure, and such modifications are intended to fall within the literal scope of the appended claims.

The invention claimed is:

1. A combustor for a gas turbine engine comprising:

combustor walls including inner and outer cylindrical liners spaced apart and circumscribing an upstream annular dome portion, the combustor walls defining at least a portion of a combustion chamber therewithin;

a plurality of fuel nozzles for injecting a fuel mixture into the combustion chamber, said fuel nozzles aligned with corresponding fuel nozzle openings defined in said dome portion; and a plurality of cooling apertures defined through said dome portion for delivering pressurized cooling air surrounding said combustor into said combustion chamber, said cooling apertures including first cooling holes and second cooling holes, said second cooling holes defining concentric circular configurations surrounding each of said fuel nozzle openings and are angled in the dome portion substantially tangentially relative to an associated one of said fuel nozzle openings, said first cooling holes being disposed in regions defined between adjacent concentric circular configurations of said second cooling holes and located proximate to the outer cylindrical liner, said first cooling holes extending substantially perpendicularly through the dome portion.

2. The combustor as defined in claim 1, wherein said regions are located in said dome portion at positions corresponding to identified hotspots therein.

3. The combustor as defined in claim 1, wherein said regions of said first cooling holes provide an improved cooling efficiency than similarly sized areas of mid dome portion having said second cooling holes therein.

4. The combustor as defined in claim 1, wherein a drag coefficient of the first cooling holes is lower than that of the second cooling holes.

5. The combustor as defined in claim 1, wherein said regions of said first cooling holes are substantially triangular in shape.

6. The combustor as defined in claim 5, wherein said substantially triangularly-shaped regions define an edge substantially parallel to a radial outer edge of the dome portion proximate the outer cylindrical liner.

7. The combustor as defined in claim 1, wherein said first cooling holes are defined within said regions in a spacing density greater than that of said second cooling holes.

8. The combustor as defined in claim 1, wherein said combustor is an annular reverse flow combustor.

9. An annular reverse flow combustor for a gas turbine engine comprising:

combustor walls including inner and outer cylindrical liners spaced apart and circumscribing an upstream annular dome portion, the combustor walls defining at least a portion of a combustion chamber therewithin;

a plurality of fuel nozzle openings defined in said dome portion, said fuel nozzle openings being adapted to receive therein fuel nozzles for injecting a fuel mixture into the combustion chamber;

a plurality of cooling apertures defined through said dome portion for delivering pressurized cooling air surrounding said combustor into said combustion chamber, said cooling apertures including first cooling holes and second cooling holes, said second cooling holes defining concentric circular configurations surrounding each of said fuel nozzle openings, said first cooling holes being disposed in regions defined between adjacent concentric circular configurations of said second cooling holes, said first cooling holes extending substantially perpendicularly through the dome portion and said second cooling holes being angled in the dome portion relative to said first cooling holes, the second cooling holes are angled in the dome portion substantially tangentially relative to an associated one of said fuel openings.

10. The combustor as defined in claim 9, wherein the regions of said first cooling holes are located proximate to the outer cylindrical liner.

11. The combustor as defined in claim 9, wherein said regions are located in said dome portion at positions corresponding to identified hotspots therein.

12. The combustor as defined in claim 9, wherein said regions of said first cooling holes provide an improved cooling efficiency than similarly sized areas of said dome portion having said second cooling holes therein.

13. The combustor as defined in claim 9, wherein a drag coefficient of the first cooling holes is lower than that of the second cooling holes.

14. The combustor as defined in claim 9, wherein said regions of said first cooling holes are substantially triangular in shape.

15. The combustor as defined in claim 14, wherein said substantially triangularly-shaped regions define an edge substantially parallel to a radial outer edge of the dome portion proximate the outer cylindrical liner.

16. The combustor as defined in claim 9, wherein said first cooling holes are defined within said regions in a spacing density greater than that of said second cooling holes.

* * * * *